US006192590B1

(12) United States Patent
Yeh

(10) Patent No.: US 6,192,590 B1
(45) Date of Patent: Feb. 27, 2001

(54) HAIRDRESSING SCISSORS

(76) Inventor: Wen-Ya Yeh, 18, Chuney-Hsueh Rd., Tainan (TW)

( * ) Notice: Subject to any disclaimer, the term of this patent is extended or adjusted under 35 U.S.C. 154(b) by 0 days.

(21) Appl. No.: 09/228,345

(22) Filed: Jan. 11, 1999

(51) Int. Cl.[7] ..... B26B 13/00
(52) U.S. Cl. ..... 30/226; 30/227; 30/254
(58) Field of Search ..... 30/254, 145, 146, 30/147, 226, 227, 229, 195, 196, 197

(56) References Cited

U.S. PATENT DOCUMENTS

| | | | | |
|---|---|---|---|---|
| 184,914 | * | 11/1876 | Scripps | 30/226 |
| D. 267,996 | * | 2/1983 | Kowalski | 30/226 |
| 550,483 | * | 11/1895 | Carrier | 30/196 |
| 1,012,918 | * | 12/1911 | Roelants et al. | 30/226 |
| 1,715,898 | * | 6/1929 | Carri | 30/227 |
| 2,272,580 | * | 2/1942 | Phillips | 30/196 |
| 2,456,858 | * | 12/1948 | Bolling | 30/147 |
| 2,840,905 | * | 7/1958 | Geiger | 30/226 |
| 5,600,891 | * | 2/1997 | Orgal | 30/226 |
| 5,875,553 | * | 3/1999 | Geib, Jr. et al. | 30/226 |
| 5,996,592 | * | 12/1999 | Choy | 30/226 |

OTHER PUBLICATIONS

Houser et al., Cable Slitter, IBM technical disclosure bulletin, vol. 13 No. 10, Mar. 1971.*

* cited by examiner

*Primary Examiner*—Kenneth E. Peterson
*Assistant Examiner*—Stephen Choi
(74) *Attorney, Agent, or Firm*—Alan Kamrath; Rider Bennett Egan & Arundel, LLP

(57) ABSTRACT

A pair of hairdressing scissors has a pair of handles, and a pivot fastening the handles pivotally. Each handle has a through hole receiving a U-shaped connection block. The U-shaped connection block has a slot and an opening. A protruded bar is disposed on the U-shaped connection block. The protruded bar has a block end and a notch defined between the block end and the U-shaped connection block.

14 Claims, 6 Drawing Sheets

FIG.3
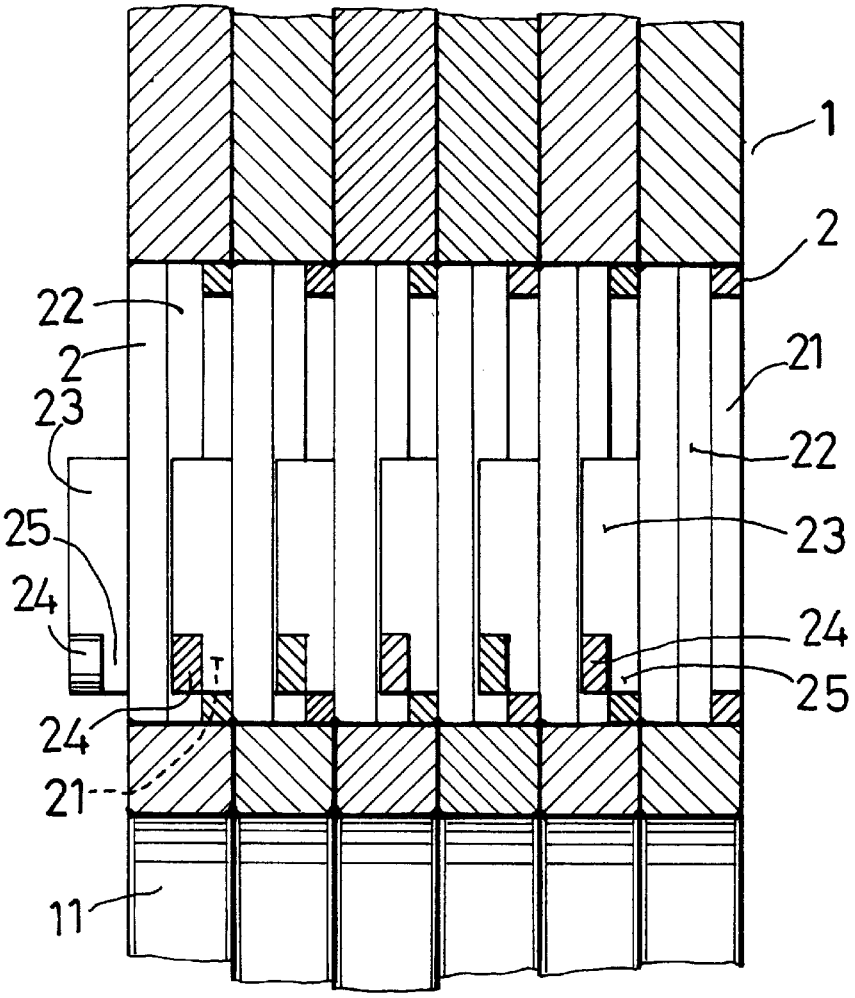
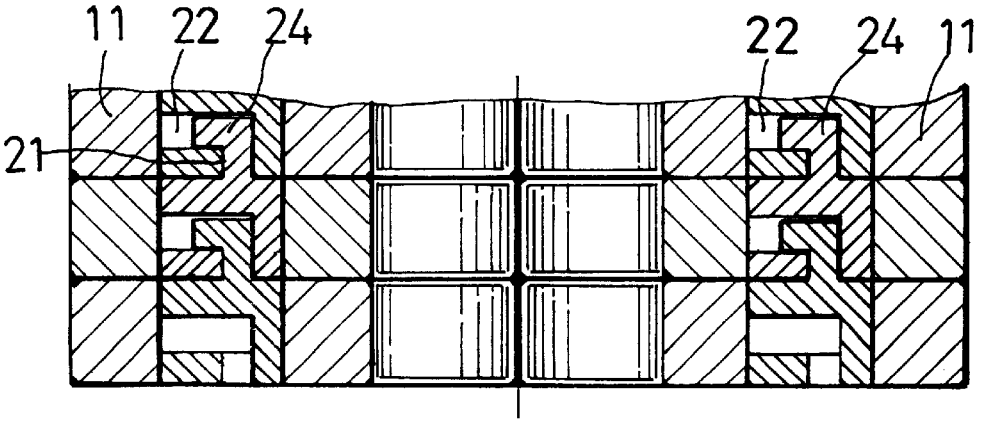
FIG.4

HAIRDRESSING SCISSORS

BACKGROUND OF THE INVENTION

The present invention relates to a pair of hairdressing scissors.

Referring to FIG. 9, a plurality of pairs of conventional hairdressing scissors 30 are combined together. However, it is difficult to keep all the pairs of conventional hairdressing scissors 30 parallel to one another. Furthermore, the fingers of the user should touch all the pairs of conventional hairdressing scissors 30.

SUMMARY OF THE INVENTION

An object of the present invention is to provide a plurality of pairs of hairdressing scissors which can be controlled by the user easily.

Another object of the present invention is to provide a plurality of pairs of hairdressing scissors which can be combined together stably so that the fingers of the user need not touch all the pairs of hairdressing scissors while operating.

In accordance with a first preferred embodiment of the present invention, a pair of hairdressing scissors comprises a pair of handles, and a pivot fastening the handles pivotally. Each of the handles has a through hole receiving a U-shaped connection block. The U-shaped connection block has a slots an opening, and a plurality of periphery serrations. A protruded bar is disposed on the U-shaped connection block. The protruded bar has a block end and a notch defined between the block end and the U-shaped connection block.

In accordance with a second preferred embodiment of the present invention, a pair of hairdressing scissors comprises a pair of handles, and a pivot fastening the handles pivotally. Each of the handles has a through hole receiving a U-shaped connection block. The U-shaped connection block has a slot and an opening. A protruded bar is disposed on the U-shaped connection block. The protruded bar has a block end and a notch defined between the block end and the U-shaped connection block.

BRIEF DESCRIPTION OF THE DRAWINGS

FIG. 3 is a partially sectional assembly view of a plurality pairs of hairdressing scissors of a first preferred embodiment in accordance with the present invention;

FIG. 4 is another partially sectional assembly view of a plurality pairs of hairdressing scissors of a first preferred embodiment in accordance with the present invention;

DETAILED DESCRIPTION OF THE INVENTION

Figure 1:
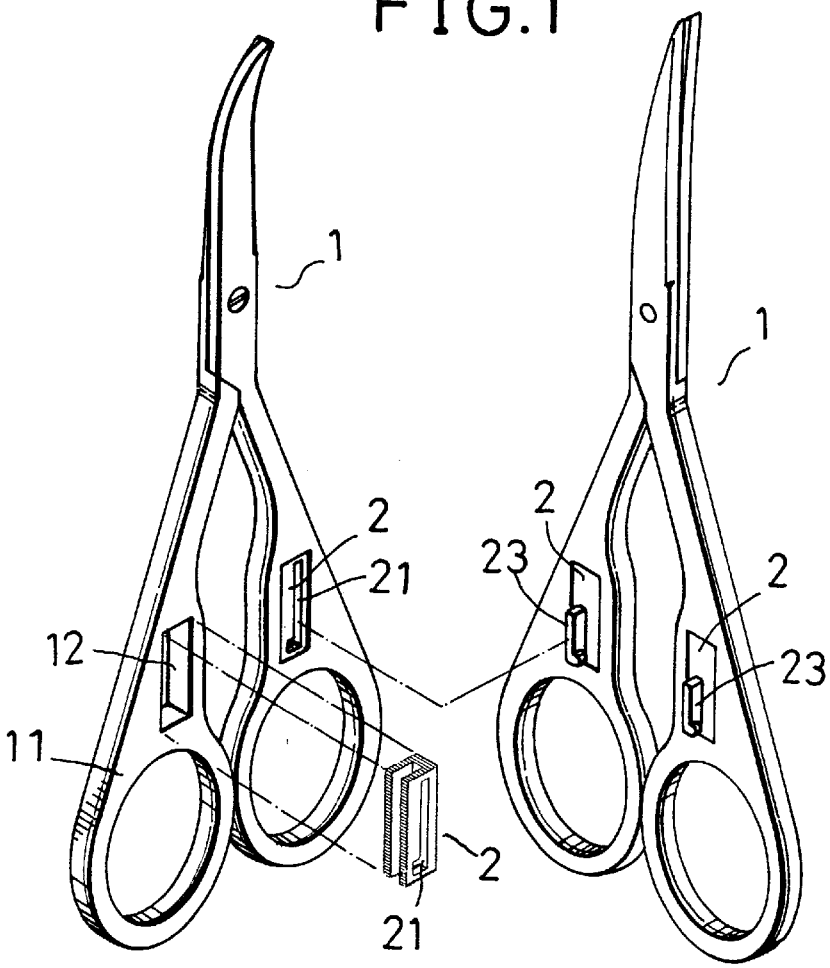
FIG. 1 is a perspective exploded view of two pairs of hairdressing scissors of a first preferred embodiment in accordance with the present invention.
Figure 2:
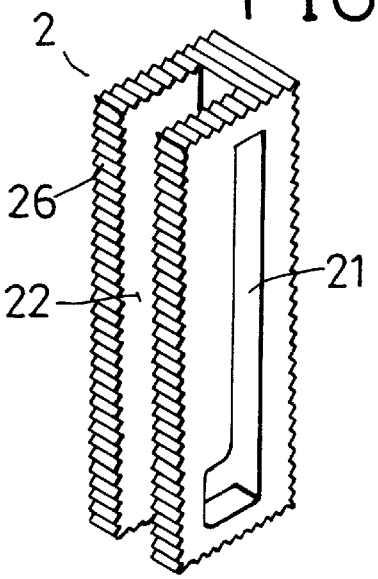
FIG. 2 is a perspective view of a connection block of a first preferred embodiment in accordance with the present invention.
Figure 2A:
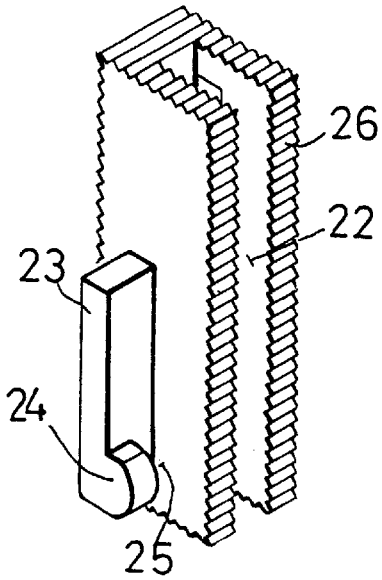
FIG. 2A is another perspective view of a connection block of a first preferred embodiment in accordance with the present invention.

Referring to FIGS. 1 to 4, a first pair of hairdressing scissors 1 comprises a pair of handles 11, and a pivot 3 fastening the handles 11 pivotally.

Each of the handles 11 has a through hole 12 receiving a U-shaped connection block 2.

The U-shaped connection block 2 has a slot 21, an opening or channel 22, and a plurality of periphery serrations 26.

A protruded bar 23 is disposed on the U-shaped connection block 2.

The protruded bar 23 has a block end 24 and a notch 25 defined between the block end 24 and the U-shaped connection block 2.

Figure 5:
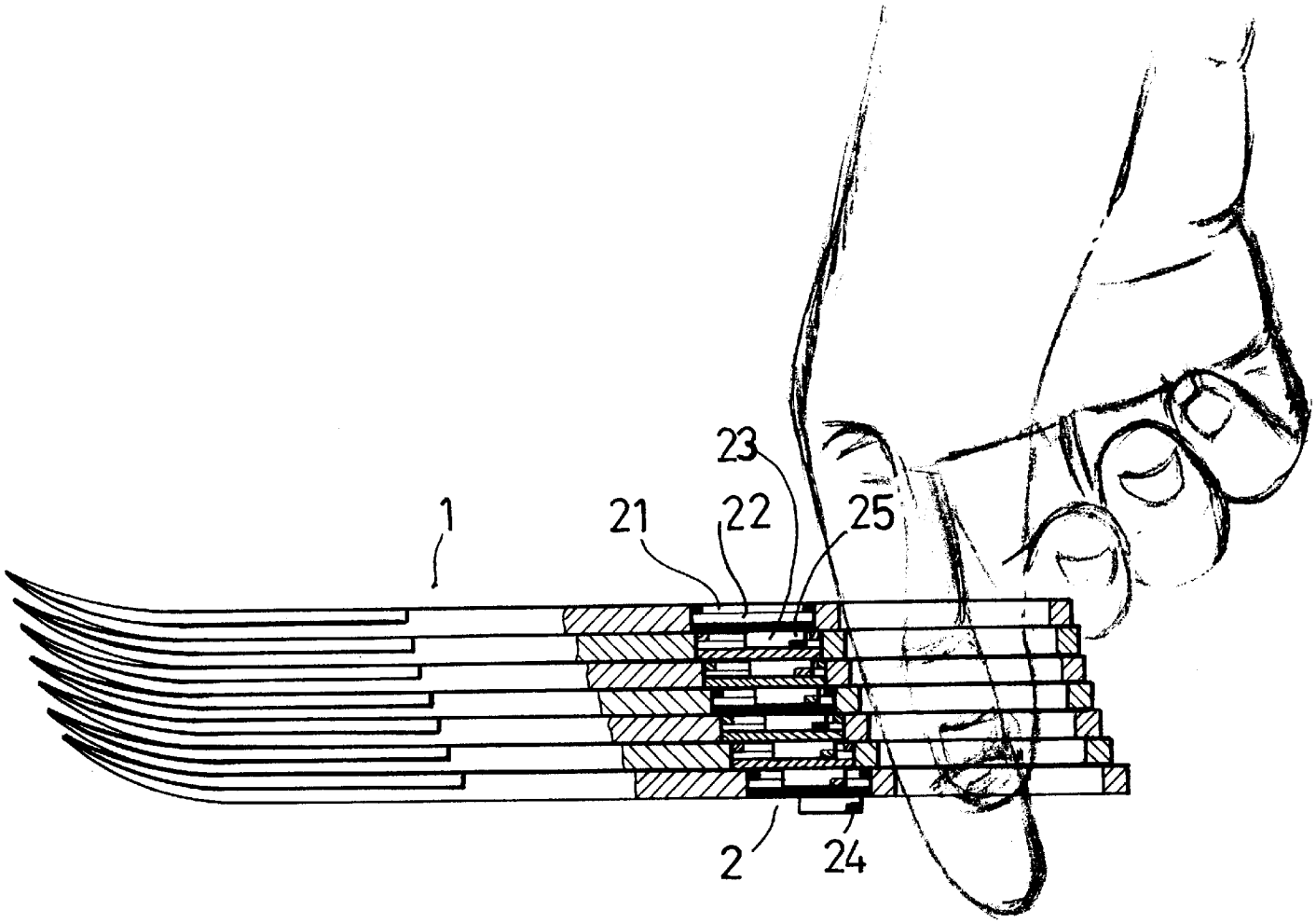
FIG. 5 is a schematic view showing an application of a plurality pairs of hairdressing scissors of a first preferred embodiment in accordance with the present invention.

Referring to FIGS. 3 to 5, a plurality pairs of hairdressing scissors 1 engage with one another via the slots 21 and the protruded bars 23. Each of the slots 21 receives the respective protruded bar 23. The user can control a plurality of pairs of hairdressing scissors with fingers easily.

Figure 6:
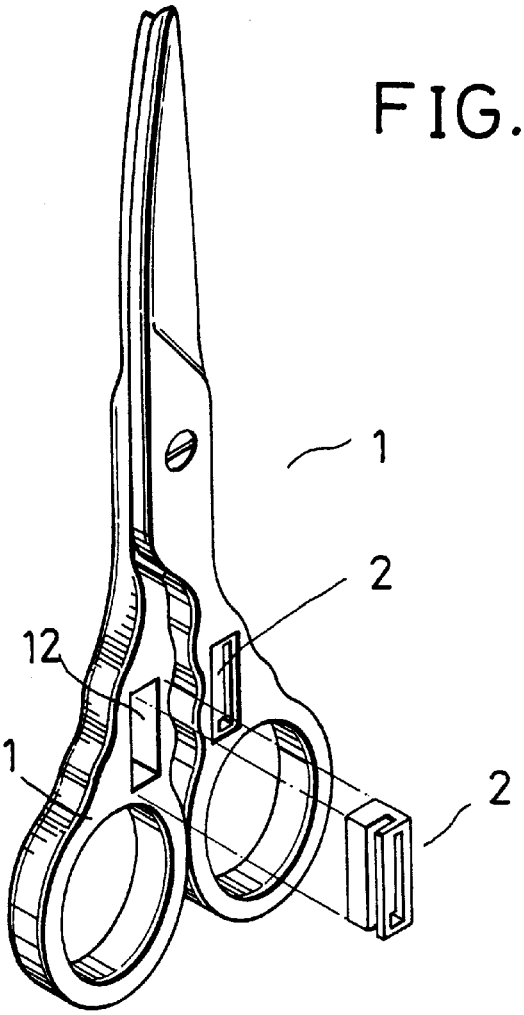
FIG. 6 is a perspective exploded view of a pair of hairdressing scissors of a second preferred embodiment in accordance with the present invention.
Figure 7:
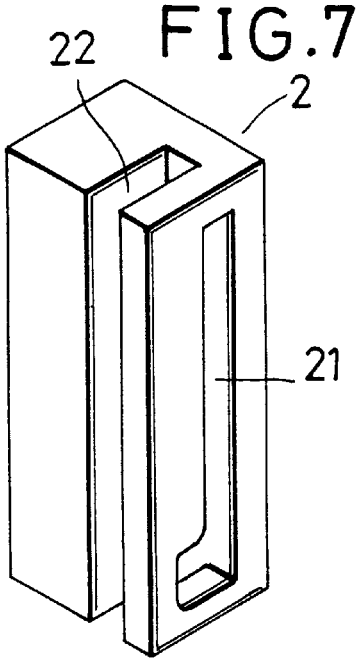
FIG. 7 is a perspective view of a connection block of a second preferred embodiment in accordance with the present invention.
Figure 7A:
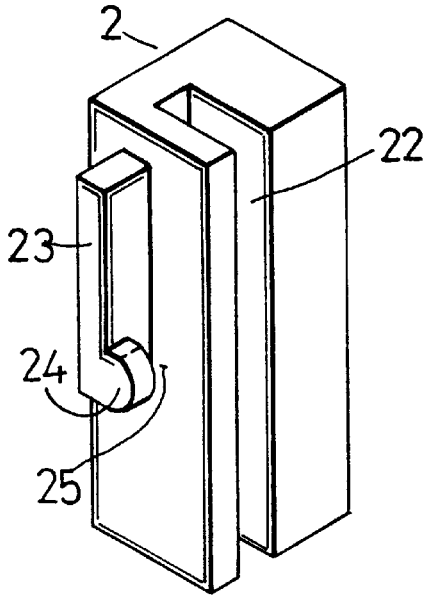
FIG. 7A is another perspective view of a connection block of a second preferred embodiment in accordance with the present invention.

Referring to FIGS. 6, 7, and 7A, a second pair of hairdressing scissors 1' comprises a pair of handles 11', and a pivot 3' fastening the handles 11' pivotally.

Each of the handles 11' has a through hole 12' receiving a U-shaped connection block 2'.

The U-shaped connection block 2' has a slot 21' and an opening 22'.

A protruded bar 23' is disposed on the U-shaped connection block 2'.

The protruded bar 23' has a block end 24' and a notch 25' defined between the block end 24' and the U-shaped connection block 2'.

Figure 8:
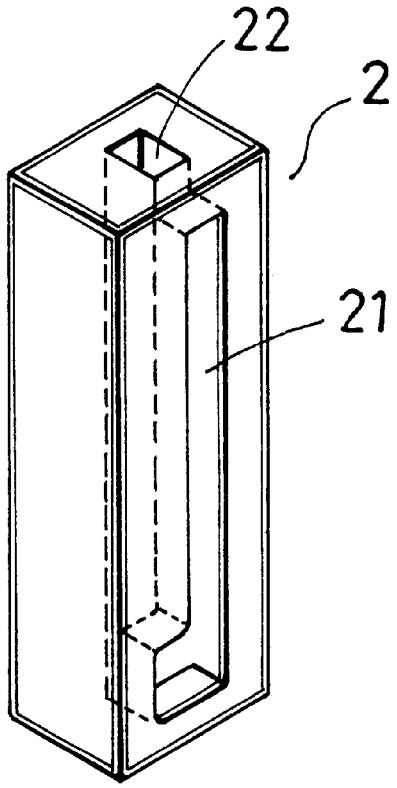
FIG. 8 is a perspective view of a connection block of a third preferred embodiment in accordance with the present invention.
Figure 8A:
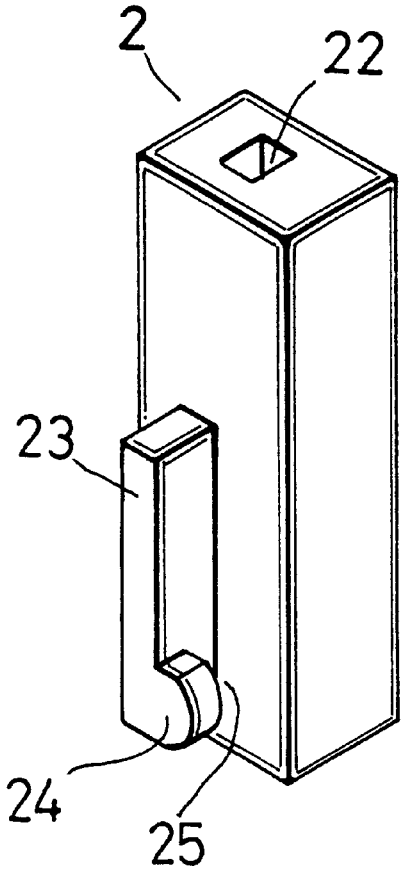
FIG. 8A is another perspective view of a connection block of a third preferred embodiment in accordance with the present invention.
Figure 9:
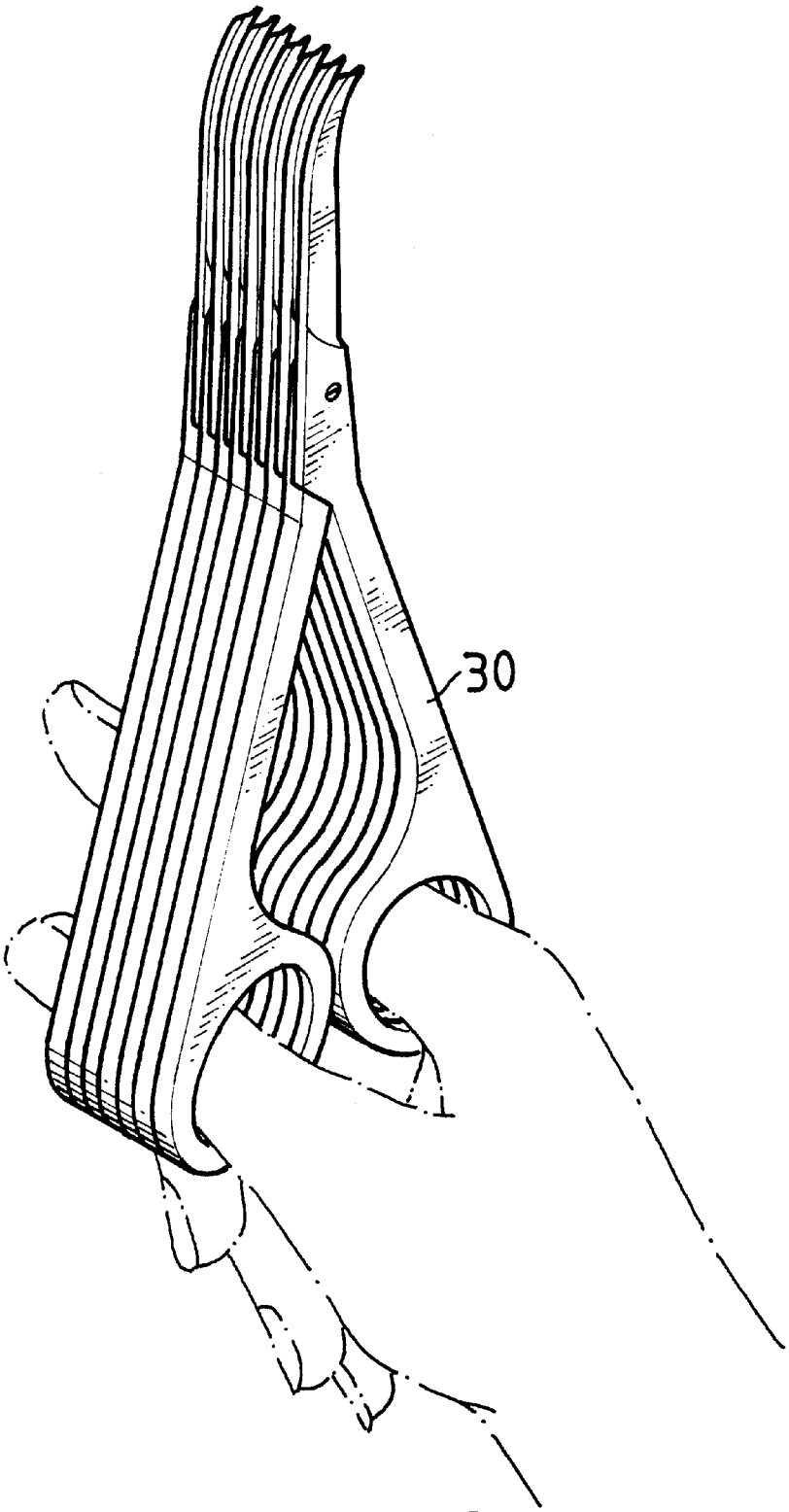
FIG.9 PRIOR ART
FIG. 9 is a perspective view of a plurality of pairs of conventional hairdressing scissors of the prior art.

Referring to FIGS. 8 and 8A, a third connection block 2" has a slot 21" and a through aperture or channel 22".

A protruded bar 23" is disposed on the connection block 2".

The protruded bar 23" has a block end 24" and a notch 25" defined between the block end 24" and the connection block 2'.

Therefore, the user can control a pair and a plurality of pairs of hairdressing scissors with fingers easily.

Furthermore, a plurality of pairs of hairdressing scissors can be combined together easily. Thus the fingers of the user need not touch all the pairs of hairdressing scissors while operating.

Since the user can hold a plurality of pairs of hairdressing scissors of the present invention stably, the present invention is superior to a pair of conventional hairdressing scissors of the prior art.

The present invention is not limited to the above embodiments but various modifications thereof may be made.

Furthermore, various changes in form and detail may be made without departing from the scope of the present invention.

I claim:

1. A pair of hairdressing scissors comprising, in combination:

a pair of handles, a pivot fastening the handles pivotally, each of the handles having a through hole receiving a U-shaped connection block, the U-shaped connection block having a slot and an opening, a protruded bar disposed on the U-shaped connection block, and the protruded bar having a block end and a notch defined between the block end and the U-shaped connection block.

2. A pair of hairdressing scissors as claimed in claim 1, wherein the U-shaped connection block has a plurality of periphery serrations.

3. A pair of hairdressing scissors as claimed in claim 2, wherein each of the U-shaped connection blocks includes first and second legs upstanding from a central member, with the slot formed in the first leg, with the protruded bar disposed on the second leg, with the opening being between the first and second legs.

4. A pair of hairdressing scissors as claimed in claim 3, wherein each of the first and second legs includes an outer face, with the protruded bar disposed on the outer face of the second leg, with the through hole extending between outer surfaces of the handles, with the outer faces being coplanar with the outer surfaces of the handle when the U-shaped connection block is received in the through hole.

5. A pair of hairdressing scissors as claimed in claim 4, wherein the slot is L-shaped.

6. A pair of hairdressing scissors as claimed in claim 1, wherein each of the U-shaped connection blocks includes first and second legs upstanding from a central member, with the slot formed in the first leg, with the protruded bar disposed on the second leg, with the opening being between the first and second legs.

7. A pair of hairdressing scissors as claimed in claim 6, wherein each of the first and second legs includes an outer face, with the protruded bar disposed on the outer face of the second leg, with the through hole extending between outer surfaces of the handles, with the outer faces being coplanar with the outer surfaces of the handle when the U-shaped connection block is received in the through hole.

8. A pair of hairdressing scissors as claimed in claim 7, wherein the slot is L-shaped.

9. A pair of hairdressing scissors as claimed in claim 1, wherein the slot is L-shaped.

10. A pair of hairdressing scissors comprising, in combination:

a pair of handles, a pivot fastening the handles pivotally, each of the handles having a through hole, a connection block, separate and distinct from a respective one of the handles, positioned in the through hole, with the connection block having a slot and an opening, and a protruded bar disposed on the connection block, the protruded bar having a block end and a notch defined between the block end and the connection block with the protruded bar being adapted to extend into a slot of an adjacent connection block of a pair of similarly constructed hairdressing scissors while the block end projects into an opening of the adjacent connection block.

11. A pair of hairdressing scissors as claimed in claim 10 wherein the slot is L-shaped.

12. A pair of hairdressing scissors as claimed in claim 11 wherein the opening is in the form of a channel, with the slot being in communication with the channel.

13. A pair of hairdressing scissors as claimed in claim 10 wherein the opening is in the form of a channel, with the slot being in communication with the channel.

14. A pair of hairdressing scissors as claimed in claim 10 wherein the connection block includes first and second outer faces, with the protruded bar disposed on the first outer face, with the through hole extending between outer surfaces of the handle, with the outer faces being coplanar with the outer surfaces of the handle when the connection block is received in the through hole.

* * * * *